US005849410A

United States Patent [19]

Nelson et al.

[11] Patent Number: 5,849,410

[45] Date of Patent: Dec. 15, 1998

[54] COEXTRUDED MONOFILAMENTS

[75] Inventors: Charles Fletcher Nelson; Robert Lee Rackley, both of Parkersburg, W. Va.

[73] Assignee: E. I. du Pont de Nemours and Company, Wilmington, Del.

[21] Appl. No.: 766,218

[22] Filed: Dec. 12, 1996

[51] Int. Cl.[6] ..... D02G 3/00

[52] U.S. Cl. ..... 428/373; 428/374

[58] Field of Search ..... 428/373, 374, 428/370; 15/167.1, 207.2

[56] References Cited

U.S. PATENT DOCUMENTS

| | | | |
|---|---|---|---|
| 2,507,299 | 5/1950 | D'Alelio et al. | 15/207.2 |
| 2,920,947 | 11/1960 | Burk et al. | 51/298 |
| 3,258,805 | 7/1966 | Rossnen | 15/167.1 |
| 3,327,339 | 6/1967 | Lemelson | 15/209 |
| 3,577,839 | 5/1971 | Charvat et al. | 15/179 |
| 4,263,691 | 4/1981 | Pakarnaeree | 15/159 A |
| 4,459,337 | 7/1984 | Hansen | 428/395 |
| 4,584,240 | 4/1986 | Herbert et al. | 428/373 |
| 4,610,925 | 9/1986 | Bond | 428/373 |
| 4,867,676 | 9/1989 | Rackley | 433/15 |
| 4,956,236 | 9/1990 | Wang | 428/373 |
| 5,313,909 | 5/1994 | Tseng et al. | 116/208 |
| 5,352,518 | 10/1994 | Muramoto et al. | 428/373 |
| 5,407,735 | 4/1995 | Fukuda et al. | 428/373 |
| 5,466,505 | 11/1995 | Fukuda et al. | 428/373 |

*Primary Examiner*—Newton Edwards
*Attorney, Agent, or Firm*—Inna Y. Belopolsky

[57] ABSTRACT

This invention relates to a coextruded monofilament having a sheath made of a first resin and a core made of a second resin which is different than the first resin and which has a higher coefficient of friction than the first resin. The core of the monofilament is exposed at the tip by conventional mechanical end-rounding techniques to form a tip with a higher coefficient of friction than the tip of a typical monofilament.

7 Claims, 2 Drawing Sheets

COEXTRUDED MONOFILAMENTS

BACKGROUND OF THE INVENTION

1. Field of the Invention

This invention relates to coextruded monofilaments which may be used, for example, in bristles for toothbrushes.

2. Description of the Related Art

Monofilaments made from nylon 6,12 or from polyester are typically circular in cross section with the tips of the monofilaments being well rounded. When used in toothbrushes, bristles made from monofilaments having rounded tips have been preferred because those bristles have a lower tendency to damage soft and hard oral tissue than bristles without rounded tips.

SUMMARY OF THE INVENTION

This invention relates to a coextruded monofilament having a sheath material made of a first resin concentric with a core material made of a second resin which is different from the first resin and which has a higher coefficient of friction than the first resin. The core material is exposed at the tip of the monofilament by conventional mechanical end rounding techniques to form a tip that has a higher coefficient of friction than the rounded tip of a conventional monofilament.

DETAILED DESCRIPTION

Figure 2:
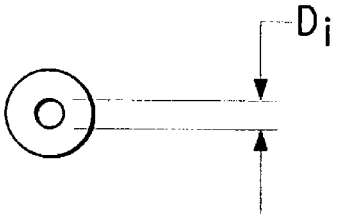
FIG. 2 is a top plan view of the coextruded monofilament.
Figure 4:
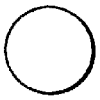
FIG. 4 is a top plan view of the conventional monofilament of FIG. 3.
Figure 1:
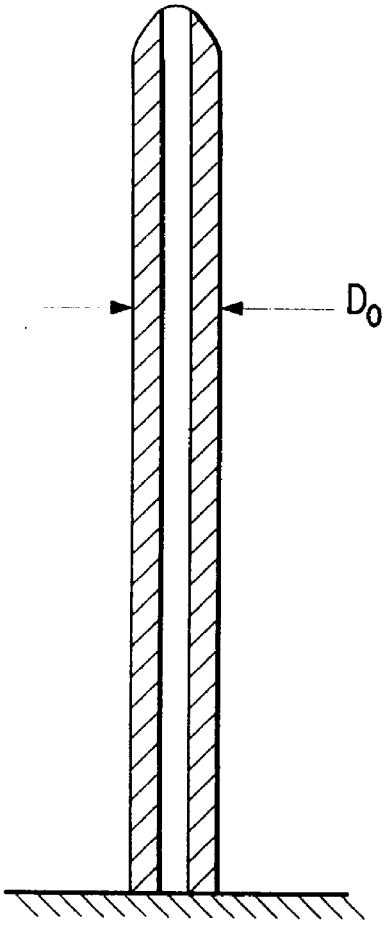
FIG. 1 is a cross-sectional view in elevation of a coextruded monofilament made in accordance with this invention.
Figure 3:
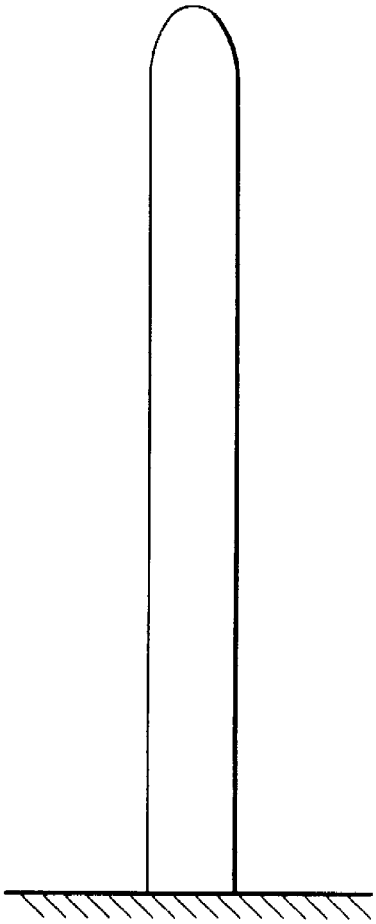
FIG. 3 is a view in elevation of a conventional monofilament.
Figure 5:
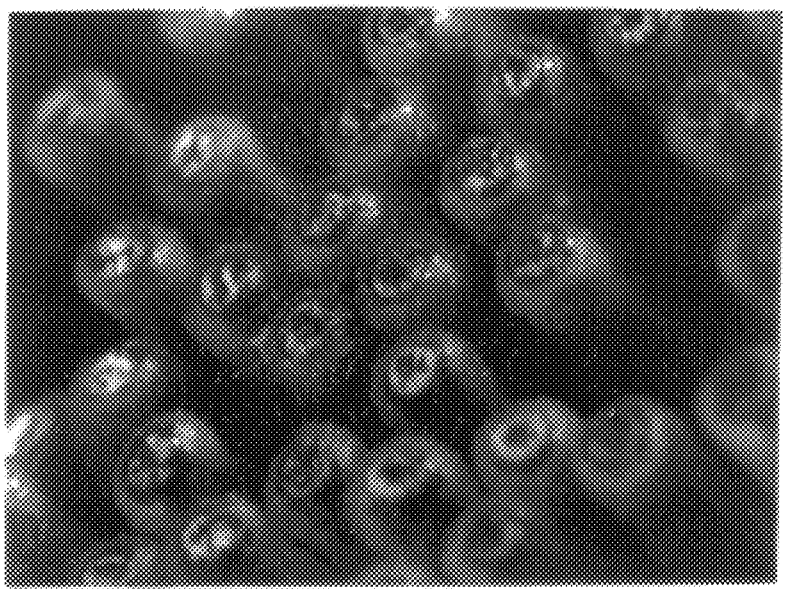
FIG. 5 is a microscope photograph at approximately 75× of the tip of the coextruded monofilament of this invention.

This invention relates to a coextruded monofilament of a sheath material made from a first resin concentric with a core material made of a second resin wherein the second resin is different from the first resin and has a higher coefficient of friction than the first resin. When the coextruded monofilament is inserted into a brush and the ends of the filament are trimmed and processed to expose the second resin on the tip of the filament. The tip of the filament then has a higher coefficient of friction than a conventional monofilament, while the filament itself maintains the excellent bend recovery properties of a conventional monofilament through the use of the first resin as the sheath of the coextruded monofilament. The purpose of the high coefficient of friction tip is to provide a better cleaning action than a conventional end-rounded monofilament. For example, if the coextruded monofilament is used as the bristle in a toothbrush, the high coefficient of friction tip will provide improved cleaning.

A used herein, the term "core" refers to the central portion of the coextruded monofilament as examined at a cross section. As used herein, the term "sheath" refers to an outer coating layer or layers over the core material on a coextruded monofilament.

Examples of combinations of sheath and core materials include a sheath material of nylon 6; 6,6; 6,10; 6,12; 6,9; 10,10; 11; 12; copolymers of nylons and mixtures thereof, and a core material of a copolyester ether such as that sold under the trademark Hytrel® by E.I. du Pont de Nemours and Company of Wilmington, Del.

Other examples of combinations of sheath and core materials include a sheath material of a nylon, a polyester, especially polyethylene terephthalate (PET) or polybutylene terephthalate (PBT), a polyurethane, polyvinylidene chloride, or polyvinylidene fluoride, or mixtures thereof, and a core material of a thermoplastic elastomer such as a copolyester ether, polyether block amide, styrene block copolymer such as styrene-butadiene-styrene or styrene-ethylene-butylene-styrene, thermoplastic elastomer blend based on styrene block copolymer, thermoplastic polyolefin such as ethylene propylene (diene) copolymer or blends thereof, or thermoplastic polyurethane, or mixtures thereof.

There is no limitation on the shape of the cross section of the core or the sheath of the coextruded monofilament. Either or both may be circular, triangular, square, pentagonal, hexagonal, any regular shaped polygon, oval, lobate, or any other shape. The core may be hollow having either single or multiple voids, such as a trilocular or tetralocular cross section.

The cross-sectional area of the core material comprises from about 10 to about 90% of the cross-sectional area of the monofilament.

EXAMPLES

Example 1

Coextruded monofilaments having a core of Hytrel® 4056 copolyester ether and a sheath of 6,12 nylon were made using conventional methods. The monofilament was conditioned at 125° C. by backwinding it through a conditioner on a spinning line and then processed into hanks. The cross-sectional area of the core was about 55% of the total cross-sectional area of the monofilament.

These coextruded monofilaments were inserted into a tuft toothbrush and the ends of the monofilaments were subjected to conventional end rounding, thus exposing the Hytrel® 4056 at the tips.

Coefficient of friction was measured for toothbrushes made of the coextruded monofilament and for toothbrushes made of 6,12 nylon monofilament. The toothbrushes were of the same design for both samples. Coefficient of friction was measured for the brush samples on glass. Four toothbrushes containing a monofilament sample were mounted on a sled, which was loaded with a 1000 gram weight, and the assembly was pulled across a horizontal glass surface at the rate of 5 inches per minute with the tips of the filament in contact with the glass surface. The force required to move the brushes across the glass surface was measured with an INSTRON tensile tester. The data below show a significantly higher coefficient of friction for the brushes made with coextruded monofilament having a Hytrel® 4056 exposed at the tips of the bristles than for the brushes made with 6,12 nylon and having end-rounded tips.

| | Coefficient of Friction | | |
|---|---|---|---|
| | I | II | III |
| Toothbrushes made with coextruded monofilament | .36 | .35 | .37 |
| Toothbrushes made with 6,12 nylon | .23 | .30 | .27 |
| % increase in coefficient of friction | 57% | 17% | 37% |

What is claimed is:

1. A coextruded monofilament comprising:

a sheath material comprising a first resin selected from the group consisting of nylon, polyester, polyurethane, polyvinylidene chloride, or polyvinylidene fluoride, or mixtures thereof, and a core material concentric with said sheath material comprising a second resin, said second resin being a thermoplastic elastomer, wherein said second resin is different from said first resin and has a higher coefficient of friction than said first resin, wherein said core material is exposed at the end of the monofilament.

2. The coextruded monofilament of claim 1, wherein said sheath material is a nylon selected from the group consisting of nylon 6; nylon 6,6; nylon 6,10; nylon 6,12; nylon 10,10; or copolymers of nylon 6 and 6,6; or mixtures thereof, and said core material is a copolyester ether.

3. The coextruded monofilament of claim 1, wherein the core material is a thermoplastic elastomer selected from the group consisting of copolyester ether, polyether block amide, styrene block copolymer, thermoplastic elastomer blends based on styrene block copolymer, thermoplastic polyolefin or blends thereof, thermoplastic polyurethane, and mixtures thereof.

4. The coextruded monofilament of claim 1, wherein the cross-sectional area of the core material comprises from about 10 to about 90% of the cross-sectional area of the monofilament.

5. The coextruded monofilament of claim 1, wherein the cross-sectional shape of the sheath is circular, triangular, square, pentagonal, hexagonal or oval.

6. The coextruded monofilament of claim 1, wherein the cross-sectional shape of the core is circular, triangular, square, pentagonal, hexagonal, oval, or lobate.

7. A brush comprising a handle associated with a head having one or more tufts made from the coextruded monofilament of any of claims 1–2.

* * * * *